US006092442A

United States Patent [19]

Macor

[11] Patent Number: 6,092,442

[45] **Date of Patent: *Jul. 25, 2000**

[54] DOUBLE-ENDED WRENCH WITH MOVABLE GRIP

[75] Inventor: Richard J. Macor, Greenwich Township, Warren County, N.J.

[73] Assignee: Proprietary Technologies, Inc., Asbury, N.J.

[ * ] Notice: Under 35 U.S.C. 154(b), the term of this patent shall be extended for 363 days.

[21] Appl. No.: 08/500,178

[22] Filed: Jul. 10, 1995

[51] Int. Cl.[7] ..... B25B 13/58

[52] U.S. Cl. ..... 81/180.1; 81/177.1

[58] Field of Search ..... 81/125.1, 177.1, 81/184, 185.2, 180.1, 489; 16/114 R

[56] References Cited

U.S. PATENT DOCUMENTS

| | | | |
|---|---|---|---|
| 2,466,884 | 4/1949 | English et al. | 81/125.1 |
| 3,981,043 | 9/1976 | Curry . | |
| 4,406,188 | 9/1983 | Mills | 81/180.1 |
| 4,890,355 | 1/1990 | Schulten | 16/114 R |
| 5,115,530 | 5/1992 | Distiso | 16/114 R |
| 5,390,746 | 2/1995 | Page | 81/489 |

*Primary Examiner*—David A. Scherbel
*Assistant Examiner*—Joni B. Danganan
*Attorney, Agent, or Firm*—Kenneth P. Glynn, Esq.

[57] ABSTRACT

A double-ended wrench is described having a movable wrench grip which may be positioned at either end of the double-ended wrench, thereby providing a user with improved comfort, torque and continuous use capabilities at both ends of the wrench. The wrench includes a movable wrench grip which may have one or more seams extending the entire length thereof to facilitate the attachment and detachment of the movable wrench grip to the double-ended wrench. Also, the movable wrench grip may have means to temporarily fix the grip at different locations along the extended central portion of the double-ended wrench, or to increase friction between the movable wrench grip and the double-ended wrench. In one preferred embodiment, there is a double-ended wrench, having a movable wrench grip thereon which has a single, wide seam extending the entire length thereof.

8 Claims, 2 Drawing Sheets

DOUBLE-ENDED WRENCH WITH MOVABLE GRIP

BACKGROUND OF THE INVENTION

1. Field of the Invention

The present invention relates to tools, particularly hand tools and most particularly double ended wrenches. A double-ended wrench is a wrench having two wrench heads positioned at either end of an extended central portion or handle thereof; and each wrench head has a configuration capable of controlling the rotation of a fastener. The present invention involves a double ended wrench having a movable wrench grip that can be positioned at either end of the double-ended wrench, thereby providing a user with improved comfort, torque and continuous use capabilities, at either end of the double-ended wrench.

SUMMARY OF THE INVENTION

The present invention involves a double-ended wrench having a movable wrench grip that can be positioned at either end of the double-ended wrench, thereby providing a user with improved comfort, torque and continuous use capabilities, at either end of said double-ended wrench. The present invention further involves said movable wrench grip having features specific to the application. The movable wrench grip may have one or more seams extending the entire length thereof, to facilitate the attachment and detachment of the movable wrench grip with the double-ended wrench. Also the movable wrench grip may have means to temporarily fix the grip at different locations of the double-ended wrench, or increase friction between the movable wrench grip and the double-ended wrench.

BRIEF DESCRIPTION OF THE DRAWINGS

The present invention as described in this specification will be more fully understood when taken in conjunction with the drawings appended hereto, wherein.

DETAILED DESCRIPTION OF DRAWINGS

The present invention, is directed towards the improvement of double-ended wrenches. A double-ended wrench shall be defined herein as any wrench having two wrench heads (regardless of type), one each positioned at either end of an extended central portion or handle thereof; and each wrench head having a configuration capable of controlling the rotation of a fastener. A double-ended wrench may have two heads of the same type, each having a different size thereon; or two heads of different types, each having the same size thereon. Respective examples would be a double-ended, box wrench, and a double-ended, combination wrench. A double-ended wrench may have any head type or combination thereof; including, but not limited to: open-end, box, ratcheting box, flare nut and flex head.

Inherently, a double-ended wrench gains versatility (two wrench heads), at the expense of user comfort (loss of potential grip or comfortable handle). Some single ended wrenches have a grip or comfortable handle at one end of the wrench, to promote comfort and reduce fatigue. This arrangement for single ended wrenches is practical and does not significantly affect the operation of the tool.

When considering a grip or comfortable handle for a double-ended wrench, it would be natural to assume that a double-ended wrench would require two grips or comfortable handles, one each at either end of wrench. However, such an arrangement for double-ended wrenches is impractical, creating significant clearance limitations for both wrench heads, and seriously affecting the operation of the tool. Furthermore, it would be very difficult to install a conventional wrench grip onto both ends of a double-ended wrench, because the wrench heads located at each end, are physically larger than the smaller, extended central portion or handle thereof, preventing installation of grip to wrench handle.

Because there are no grips, or comfortable handles for double-ended wrenches, a user must rely upon the integral handle of the wrench, which has a shape and configuration that promotes user discomfort and fatigue. This discomfort and fatigue adversely affects the torque and continuous use capabilities of the tool.

It is an object of the present invention therefore, to improve the comfort, torque and continuous use capabilities of double-ended wrenches. This objective is accomplished through the present invention, double-ended wrench with movable wrench grip, as defined herein.

Figure 1:
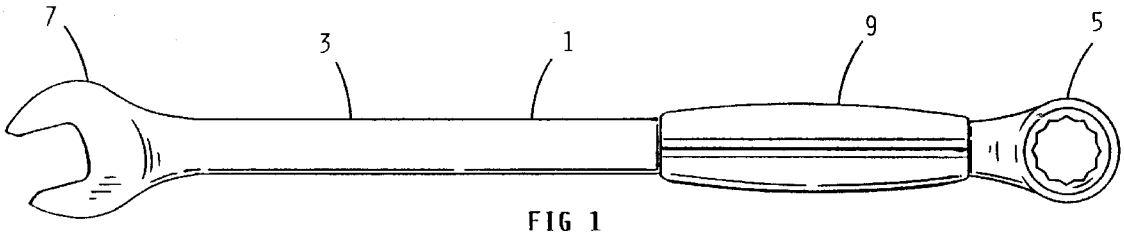
FIG. 1 shows a top view of a present invention double-ended wrench having a movable wrench handle thereon.

Referring now to FIG. 1, there is shown a present invention double-ended wrench 1, having two wrench heads 5 and 7, an extended, central portion or handle 3, and movable wrench grip 9, shown in a top view. Wrench head 5, is a box type head, and wrench head 7 is an open-end type head, each having a configuration capable of controlling the rotation of a fastener. Both head types combined in one wrench form a combination wrench. A combination wrench is just one form of a double-ended wrench. Please note, that a double-ended wrench may have any head type or combination thereof; including, but not limited to: open-end, box, ratcheting box, flare nut and flex head. In this Figure, movable wrench grip 9, is positioned towards the box, wrench head side of the wrench, allowing use of the open-end, wrench head 7. During the application of torque, movable wrench grip 9 will have a tendency to move away from center and off the end of the wrench. But wrench head 5 will prevent movable wrench grip 9 from moving off the wrench. This is because the cavity within movable wrench grip 9, is much smaller in dimension than the outer dimensions of wrench head 5, or wrench head 7 for that matter.

Without movable wrench grip 9, a user would rely upon the wrench handle 3 to apply torque to this wrench. Wrench handle 3, is not very thick, promoting discomfort and fatigue. In fact, a user may have to stop periodically during continuous use to minimize discomfort and fatigue. Movable grip 9 however, provides a thicker, more comfortable surface, thereby improving comfort, torque and continuous use capabilities, at either end of the double-ended wrench.

Figure 2:
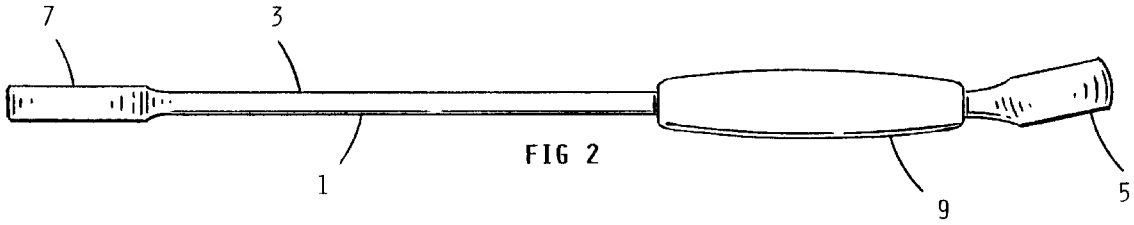
FIG. 2 shows a side view of the present invention double-ended wrench shown in FIG. 1.

FIG. 2 illustrates a side view of the present invention double-ended wrench shown in FIG. 1. In this figure, note how thin wrench handle 3 is. Without movable wrench grip 9, a user must rely upon this wrench handle 3, to apply torque. It is easy to understand how such use can promote discomfort and fatigue.

Figure 3:
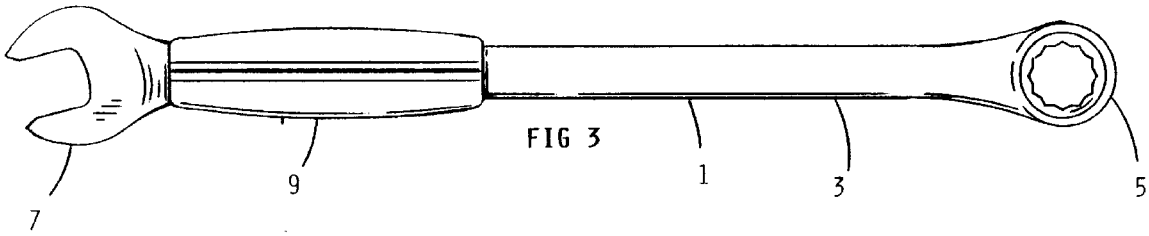
FIG. 3 shows a top view of the present invention double-ended wrench shown in FIGS. 1 and 2, with the movable wrench grip moved to an alternate position.

FIG. 3 illustrates a top view of the present invention double-ended wrench shown in FIG. 1, except movable wrench grip 9 has been repositioned towards the open-end wrench head side of the wrench to allow the use of box wrench head 5. Please note that when movable wrench grip 9 is positioned to either side of double-ended wrench 1, the other side of the wrench may be used as normal, without requiring additional clearance. During the application of torque, movable wrench grip 9 will have a tendency to move away from center and off the end of the wrench. Please note that open end wrench head 7, will prevent movable wrench grip 9 from moving off the wrench. This is because the cavity within movable wrench grip 9, is much smaller in dimension than the outer dimensions of open end wrench head 7.

Figure 4:
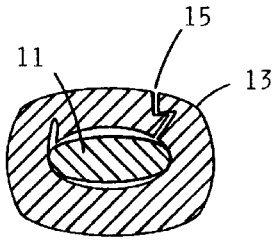
FIGS. 4, 5, 6 and 7 each show a front, cross section view of the present invention double-ended wrench handle, with a different movable wrench grip thereon.

FIG. 4 illustrates a front, cross section view of a present invention double-ended wrench 11, with a movable wrench grip 13, thereon. Movable, wrench grip 13 has seam 15, extending the entire length thereof to facilitate the attachment and detachment of movable wrench grip 13, with double-ended wrench 11. In this figure, movable wrench grip 13 is made from a semi-rigid, rubber like material which provides for the fold and snap type assembly and installation of this one piece wrench grip.

Figure 5:
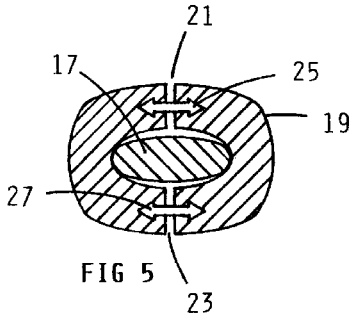

FIG. 5 illustrates a front, cross section view of another present invention double-ended wrench 17, with movable wrench grip 19 thereon. Movable wrench grip 19 has seams 21 and 23, each extending the entire length thereof to facilitate the attachment and detachment of moveable wrench grip 19, with double-ended wrench 17. Barbed pins 25 and 27 provide for the assembly of moveable wrench grip 19 at seams 21 and 23. In this figure, moveable wrench grip 19 is made from a very strong, rigid, plastic type material, which provides for the hammer or press type assembly and installation of this two piece wrench grip.

Figure 6:
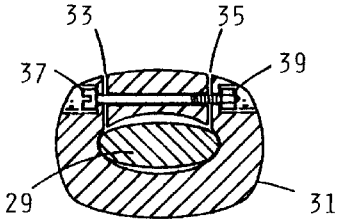

FIG. 6 illustrates a front, cross section view of another present invention double-ended wrench 29, with moveable wrench grip 31 thereon. Moveable wrench grip 31 has seams 33 and 35, extending the entire length thereof to facilitate the attachment and detachment of moveable wrench grip 31, with double-ended wrench 29. Machine screw 37 and nut insert 39 provide for the assembly of moveable wrench grip 31 at seams 33 and 35. In this figure, moveable wrench grip 31 is made from a strong, rigid, plastic type material, which provides for the screw and nut type assembly and installation of this two piece wrench grip.

Figure 7:
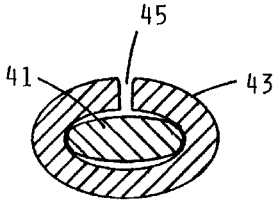

FIG. 7 illustrates a front, cross section view of another present invention double-ended wrench 41, with moveable wrench grip 43, thereon. Moveable wrench grip 43 has seam 45 extending the entire length thereof to facilitate the attachment and detachment of moveable wrench grip 43, with double-ended wrench 41. In this figure, moveable wrench grip 43 is made from a strong, plastic-like material, which provides for the twist and snap type installation of this one piece wrench grip.

Referring again to FIGS. 4, 5, 6 and 7, please that each wrench grip has at least one seam thereon, to facilitate the attachment and detachment of the moveable wrench grip with the double-ended wrench. This is because a one piece moveable wrench grip can not be installed onto a one piece, double-ended wrench, unless the cavity within the moveable wrench grip is larger than the smallest wrench head, of the one piece, double-ended wrench. Such an arrangement would create a moveable wrench grip that was too large, fit poorly, and easily slid off the wrench under use. Therefore, preferred embodiments of the moveable wrench grip will have at least one seam extending the entire length thereof.

Figure 8:
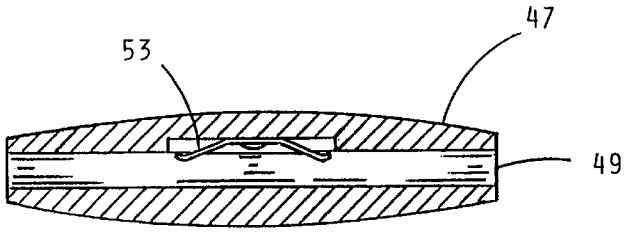
FIGS. 8 and 9 each show a side, cross section view of a present invention movable wrench grip, each having a different provision to increase friction between the movable wrench grip and double-ended wrench.

FIG. 8 shows a side, cross section view of a present invention moveable wrench grip 47, having wrench cavity 49, and friction spring 53. Wrench cavity 49 extends the entire length of moveable wrench grip 47. Moveable wrench grip 47 is made of a strong, plastic-like material, and the cavity 49 has height/width dimensions similar to the height/width dimensions of the double-ended wrench handle it is to be used upon. Friction spring 53 extends into wrench cavity 49 to provide a durable means to increase friction between moveable wrench grip 47 and said double-ended wrench handle not shown. A user will need to apply moderate force to overcome this friction, when sliding moveable wrench grip 47 to either end of the double-ended wrench, not shown. When the double-ended wrench is in use and under torque, moveable wrench grip 47 will be physically confined and held in place by the wrench head of the double-ended wrench, next to it and at the arc of the torque radius. The wrench head is not shown in this figure.

Figure 9:
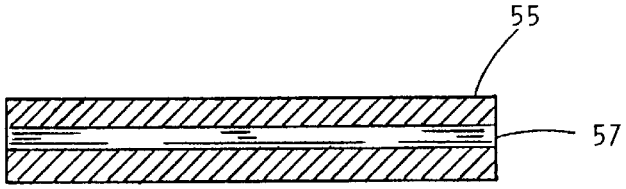

FIG. 9 shows a side, cross section view of another present invention movable wrench grip 55 having wrench cavity 57. Wrench cavity 57 extends the entire length of moveable wrench grip 55. Moveable wrench grip 55 is made of a strong, plastic-like material having some elastic properties, and wrench cavity 57 has height/width dimensions slightly smaller than the height/width dimensions of the double-ended wrench handle it is to be used upon. Because wrench cavity 57 has dimensions slightly smaller than those of said double-ended wrench handle, said elastic properties of moveable wrench grip 55 act as the means to increase friction between moveable wrench grip 55 and the double-ended wrench handle, not shown. Therefore, a means to increase friction between a moveable wrench grip and a double-ended wrench, may be achieved through cavity dimension and material elasticity. When the double-ended wrench is in use and under torque, moveable, wrench grip 55 will be physically confined and held in place by the wrench head of said double-ended wrench next to it and at the arc of the torque radius. The wrench head is not shown in this figure.

Figure 10:
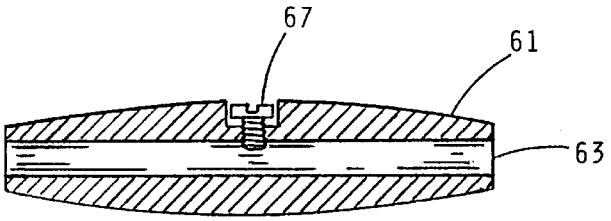
FIG. 10 shows a side, cross section view of a present invention movable wrench grip having provision to temporarily fix the movable wrench grip at different locations of the double-ended wrench.

FIG. 10 shows a side, cross section view of another present invention, movable wrench grip 61 having wrench cavity 63, and friction screw 67. Wrench cavity 63 extends the entire length of moveable wrench grip 61 shown. Moveable wrench grip 61 is made of a very strong plastic-like material and wrench cavity 63 has height/width dimensions similar to the the height/width dimensions of the double-ended wrench handle it is to be used upon. Friction screw 67 extends into wrench cavity 63, to provide an adjustable means to increase friction between moveable wrench grip 61 and the double-ended wrench handle not shown. Screw 67 is threaded and installed in moveable wrench grip 61 as shown. Furthermore, screw 67 may temporarily fix moveable wrench grip 61 at different locations of the double-ended wrench when fully tightened. When the double-ended wrench is in use and under torque, moveable wrench grip 61 will be physically confined and held in place by the wrench head of the double-ended wrench, next to it and at the arc of the torque radius. The wrench head is not shown in this figure.

Figure 11:
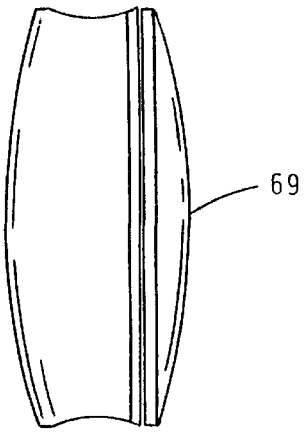
FIGS. 11, 12 and 13 each show a top view, preferred embodiment, of a present invention movable wrench grip.
Figure 12:
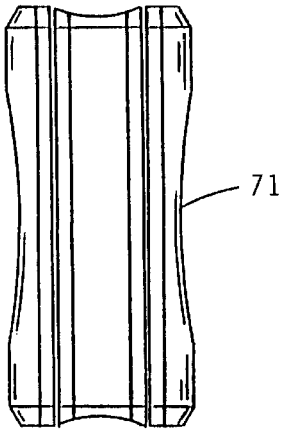
Figure 13:
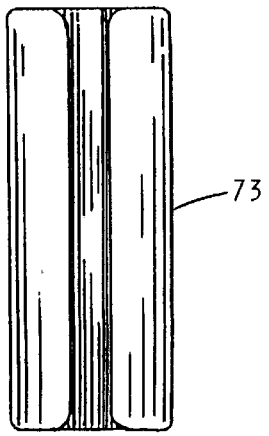

In FIGS. 11, 12 and 13 are shown moveable wrench grips 69, 71 and 73 respectively. Moveable wrench grip 69, has one seam extending the entire length thereof; moveable wrench grip 71 has two seams extending the entire length thereof; and moveable wrench grip 73 has one wide seam extending the entire length thereof. The seams are, in each case, a feature of the present invention moveable wrench grip, intended for a one piece, double-ended wrench as specified herein.

Obviously, numerous modifications and variations of the present invention are possible in light of the above teachings. It is therefore understood that within the scope of the appended claims, the invention may be practiced otherwise than as specifically described herein.

What is claimed is:

1. A double-ended wrench comprising:

(a) an extended central portion having a first end and a second end, and having two wrench heads, one positioned at said first end and another positioned at said second end of said central portion, and each of said wrench heads having a configuration capable of controlling the rotation of a fastener; and (b) a wrench grip, said wrench grip being shorter than and movable along said extended central portion, whereby said wrench grip is positionable at the first end of said extended central portion without contacting said second end thereof, and is also positionable at said second end of said extended central portion without contacting said first end thereof, and said wrench grip having a cavity therein with a dimension less than an outer dimension of each of said wrench heads whereby the movement of said wrench grip along said extended central portion is confined by said two wrench heads, and further wherein said wrench grip is frictionally attached to said extended central portion such that an application of predetermined force is necessary to render said wrench grip movable, and still further wherein said movable wrench grip comprises at least two interconnecting parts that are assembled together as one when installed upon said double-ended wrench.

2. The double-ended wrench of claim 1 wherein said movable wrench grip has at least one means to temporarily fix said movable wrench grip at different locations of said double-ended wrench.

3. A double-ended wrench comprising:

(a) an extended central portion having a first end and a second end, and having two wrench heads, one positioned at said first end and another positioned at said second end of said central portion, and each of said wrench heads having a configuration capable of controlling the rotation of a fastener; and (b) a wrench grip, said wrench grip being shorter than and movable along said extended central portion, whereby said wrench grip is positionable at the first end of said extended central portion without contacting said second end thereof, and is also positionable at said second end of said extended central portion without contacting said first end thereof, and said wrench grip having a cavity therein with a dimension less than an outer dimension of each of said wrench heads whereby the movement of said wrench grip along said extended central portion is confined by said two wrench heads, and further wherein said wrench grip is frictionally attached to said extended central portion such that an application of predetermined force is necessary to render said wrench grip movable, and still further wherein said movable wrench grip comprises at least two parts that are assembled together as one onto said double-ended wrench using fastening hardware.

4. The double-ended wrench of claim 3 wherein said movable wrench grip has at least one means to temporarily fix said movable wrench grip at different locations of said double-ended wrench.

5. A movable wrench grip for use with double-ended wrenches, which comprises:

said movable wrench grip which may be installed upon and positioned at either end of a double-ended wrench, such that its movement thereon may be confined by two, opposite wrench heads of said double-ended wrench, said movable wrench grip having an elongated, hollow body and also having at least one seam extending from one end to the other end thereof, to facilitate the attachment and detachment of said movable wrench grip with said double-ended wrench, said movable wrench grip having frictional means to create a predetermined friction to be overcome by an application of predetermined force to render said movable wrench grip movable along said double-ended wrench, wherein said wrench grip comprises at least two interconnecting parts that are assembled together as one when installed upon said double-ended wrench.

6. The movable wrench grip of claim 5 wherein said movable wrench grip has at least one means to temporarily fix said movable wrench grip at different locations of said double-ended wrench.

7. A movable wrench grip for use with double-ended wrenches, which comprises:

said movable wrench grip which may be installed upon and positioned at either end of a double-ended wrench, such that its movement thereon may be confined by two, opposite wrench heads of said double-ended wrench, said movable wrench grip having an elongated, hollow body and also having at least one seam extending from one end to the other end thereof, to facilitate the attachment and detachment of said movable wrench grip with said double-ended wrench, said movable wrench grip having frictional means to create a predetermined friction to be overcome by an application of predetermined force to render said movable wrench grip movable along said double-ended wrench, wherein said wrench grip comprises at least two parts that are assembled together as one onto said double-ended wrench using fastening hardware.

8. The movable wrench grip of claim 7 wherein said movable wrench grip has at least one means to temporarily fix said movable wrench grip at different locations of said double-ended wrench.

* * * * *